US007056106B2

(12) United States Patent
Lee et al.

(10) Patent No.: US 7,056,106 B2
(45) Date of Patent: Jun. 6, 2006

(54) DISCHARGE VALVE APPARATUS FOR RECIPROCATING COMPRESSOR

(75) Inventors: Hyuk Lee, Goyang (KR); Jung-Sik Park, Gwangjin-Gu (KR); Gye-Young Song, Gwangmyong (KR); Bon-Cheol Ku, Kimhae (KR)

(73) Assignee: LG Electronics Inc., Seoul (KR)

( * ) Notice: Subject to any disclaimer, the term of this patent is extended or adjusted under 35 U.S.C. 154(b) by 670 days.

(21) Appl. No.: 10/048,020

(22) PCT Filed: May 19, 2001

(86) PCT No.: PCT/KR01/00827

§ 371 (c)(1),
(2), (4) Date: Mar. 11, 2002

(87) PCT Pub. No.: WO01/92722

PCT Pub. Date: Dec. 6, 2001

(65) Prior Publication Data

US 2002/0150488 A1 Oct. 17, 2002

(30) Foreign Application Priority Data

May 29, 2000 (KR) ..... 2000/29045

(51) Int. Cl.
*F04B 39/00* (2006.01)

(52) U.S. Cl. ..... 417/570; 137/543.17

(58) Field of Classification Search ..... 417/570; 137/540, 543.17

See application file for complete search history.

(56) References Cited

U.S. PATENT DOCUMENTS 1,951,215 A * 3/1934 Sidney ..... 417/494
2,258,426 A * 10/1941 Smith ..... 417/504
2,600,554 A * 6/1952 Lyons ..... 239/124
3,406,715 A * 10/1968 Hruby, Jr. ..... 137/550
3,811,470 A * 5/1974 Schaefer ..... 137/515.7
4,212,316 A * 7/1980 Basch et al. ..... 137/543.17
4,295,412 A * 10/1981 Hachiro ..... 91/468
5,984,652 A * 11/1999 Gruett et al. ..... 417/553

FOREIGN PATENT DOCUMENTS

| | | | |
|---|---|---|---|
| JP | 59-51177 | A | 3/1984 |
| JP | 59-54785 | A | 3/1984 |
| JP | 59-051177 | | 3/1984 |
| JP | 59-054785 | | 3/1984 |
| JP | 63-183278 | A | 7/1988 |
| JP | 63-183278 | | 7/1988 |
| JP | 04-134192 | | 5/1992 |
| JP | 04-134192 | A | 5/1992 |
| KR | 10-1997-0011403 | A | 3/1997 |
| KR | 20-1997-0010097 | U | 3/1997 |
| KR | 20-1997-0011402 | U | 3/1997 |

(Continued)

*Primary Examiner*—Charles G. Freay
(74) *Attorney, Agent, or Firm*—Birch, Stewart, Kolasch & Birch, LLP

(57) ABSTRACT

A discharge valve apparatus for a reciprocating compressor comprises a discharge cover having built-in volume so as to cover a front end surface of the cylinder; a discharge valve disposed so as to be contacted/separated to/from the front end surface of the cylinder by a piston which undergoes a reciprocating movement inside the cylinder; and a valve spring having both ends respectively adhered to rear side of the discharge valve and to inner surface of the discharge cover so as to elastically support the rear side of the discharge valve. A rotation radius of the valve spring of a conical type is formed to be gradually reduced or increased so that impacts of a part to other parts during the compression can be prevented. Accordingly, when the valve spring is compressed in accordance with the compression and discharge strokes of the piston, the impacting noise caused by the impacts of the respective parts in the valve spring can be prevented previously.

20 Claims, 7 Drawing Sheets

FOREIGN PATENT DOCUMENTS

| | | | |
|---|---|---|---|
| KR | 10-1997-0075353 | A | 12/1997 |
| KR | 10-1997-0075360 | A | 12/1997 |
| KR | 10-1999-0016945 | A | 5/1999 |
| KR | 10-2000-0031929 | | 6/2000 |
| KR | 10-2000-0038301 | | 7/2000 |
| KR | 10-2000-0038302 | | 7/2000 |
| KR | 10-2000-0038305 | | 7/2000 |
| KR | 10-2000-0038306 | | 7/2000 |
| KR | 10-2000-0038796 | | 7/2000 |
| KR | 10-2000-0038797 | | 7/2000 |
| KR | 10-2000-0046839 | | 7/2000 |
| KR | 10-2002-0273387 | | 9/2000 |
| KR | 10-2001-0026721 | | 4/2001 |

* cited by examiner

DISCHARGE VALVE APPARATUS FOR RECIPROCATING COMPRESSOR

This application is the national phase under 35 U.S.C. §371 of PCT International Application No. PCT/KR01/00827 which has an International filing date of May 19, 2001, which designated the United States of America and was published in English.

TECHNICAL FIELD

The present invention relates to a discharge valve apparatus for a reciprocating compressor, and particularly, to a shape of the valve spring of a valve assembly applied to a reciprocating compressor and to a fabrication method for the discharge valve.

BACKGROUND ART

Generally, an axial direction discharge valve assembly among valve assemblies of a general reciprocating compressor is a device in which a piston installed as a single body with an armature of a motor undergoes a linear reciprocating movement inside a cylinder, sucks a refrigerant gas, and compresses and discharges the refrigerant gas to moving direction of the opened/closed when the piston undergoes the reciprocating movement is closely related to a function of the entire discharge valve assembly.

FIGS. 1 and 2 are a perspective view and a longitudinal cross-sectional view showing an embodiment of the axial discharge valve assembly (hereinafter, referred to as discharge valve assembly) described above.

As shown therein, in the conventional discharge valve assembly, a piston 1 integrated with an armature (not shown) of a motor is inserted into a cylinder 2, and undergoes a linear reciprocating movement. And the discharge valve assembly comprises: a discharge cover 3 fixedly coupled to front end surface of the cylinder 2 for forming a certain discharge space S2; a discharge valve 4 of hemisphere shape which is installed in the discharge cover 3 for controlling the discharge of the compressed gas by opening/closing the cylinder 2 as contacted/separated to/from the front end surface of the cylinder 2 in the discharge cover 3 while the reciprocating movement of the piston 1; and a valve spring 5 supported between the discharge cover 3 and the discharge valve 4 for elastically supporting the reciprocating movement of the discharge valve 3.

The valve spring 5 is a cylindrical compressed coil spring wound so as to have same spring constant and same rotation radius from starting portion to ending portion, and its one end is adhered to inner bottom surface of the discharge cover 3, and the other end is adhered to rear end of the discharge valve 4.

Unexplained reference numerals 1*a* designates a refrigerant gas passage, 2*a* is a coupling hole, 3*a* is a flange unit, 3*b* is a discharge hole, 6 is a suction valve, and S1 is a compression space.

Hereinafter, operation of the discharge valve device in the conventional reciprocating compressor will be described.

When the piston 1 integrated with the armature (not shown) of the reciprocating motor (not shown) undergoes a reciprocating movement inside the cylinder 2, the refrigerant gas is sucked into the compression space S1 of the cylinder through the refrigerant gas passage 1*a* formed inside the piston 1, then compressed and discharged to outside passing through the discharge space S2 of the discharge cover 3.

As shown in FIG. 3A, new refrigerant gas is sucked through the refrigerant passage 1*a* of the piston 1 during the suction stroke of the piston 1, then the refrigerant gas pushes a suction valve 6 installed on front end of the piston 1, and sucked and compressed in the compression space S1, and after that, discharged to the discharge space S2 at a certain time.

After that, as shown in FIG. 3B, the sucked gas in the compression space S1 of the cylinder 2 is compressed by the piston during the compression and discharge strokes of the piston 1, and after that, the gas is discharged into the discharge space S2 while pushing the discharge valve 4 at a certain time. And, the compressed gas filled in the discharge space S2 is pushed by compressed gas which is newly compressed during next compression and discharge strokes of the piston 1, and then discharged out of the discharge valve assembly.

On the other hand, the valve spring 5 is pushed together with the discharge valve 4 during the discharge strokes of the piston 1 and compressed, and then makes the discharge valve 4 return by being stretched at a certain degree during the suction stroke of the piston 1.

Hereinafter, a fabrication method for the discharge valve 5 will be described as follows.

As shown in FIG. 4, the discharge valve 5 is fabricated using a die-casting method which injects an appropriate medium into a fixed first metal mold 7 and into a movable second metal mold 8 and presses.

At that time, a gate through which the medium is injected is a side gate 9 or a center gate 10 formed on side unit of the discharge valve 5. In addition, a parting line 11 which is generated after the product is molded is formed on surface on which the first metal mold 7 and the second metal mold 8 are contacted each other.

FIG. 5 is a perspective view showing the conventional discharge valve 5 formed by the above fabrication method. In FIG. 5, the reference numeral 12 designates a pressure face unit contacting with the cylinder 2, and the reference numeral 14 designates a pressure back face unit facing to the pressure face unit and closely supporting the one end of the valve spring 5.

However, there are some problems as follows in the conventional discharge valve device.

The valve spring 5 is pushed to the discharge cover 3 direction with the discharge valve 4 when the compression and discharge strokes of the piston 1 are made because the cylindrical valve spring is used, and entire parts of the valve spring 5 are compressed as closely contacted with each other, whereby a part of the valve spring 5 impacts with next part and impact noise is generated.

Also, the coupled part of the valve spring 5 and the discharge cover 3 is free end state, an eccentric force of the valve spring 5 is generated between the inner side surface of the discharge cover 3 and the valve spring 5 having flowability in moving, and therefore the movement of the discharge valve is not concentric with the axial line or a local abrasion is generated between the two members. In addition, the discharge valve is touches with inner wall surface of the discharge cover when the compression stroke is made, and therefore a noise and abrasion are generated.

In addition, the discharge valve 5 is fabricated by a press method using a metal mold, and the parting line 11 is formed on the pressure face unit 12 which contacts to the front end surface of the cylinder 2. And the parting line 11 may generates a burr, and then it is contacted to the inner side surface of the discharge cover 3 when the discharge valve 5 is operated. Therefore, a noise is generated or the movement of the discharge valve 5 is not stable.

Also, in case that the gate of metal mold is formed on side surface of the discharge valve 5, the molded product may be distorted because of flowing characteristics of the injected medium and the movement of the discharge valve is not stable because of inequality in the medium density after molding, whereby the discharge noise is made. In addition, in case that the gate is formed on the pressure face unit 14 direction, there is no machining allowance for post-fabrication, and therefore it is difficult to fabricate.

DETAILED DESCRIPTION OF THE INVENTION

Therefore, an object of the present invention is to provide a discharge valve apparatus for a reciprocating compressor which can block impact noise by preventing respective parts of a valve spring from impacting with each other even if the valve spring is compressed during compression and discharge strokes of a piston.

Also, another object of the present invention is to provide a discharge valve apparatus for a reciprocating compressor in which a molded product stays adhering to a fixed metal mold by forming a parting line which is formed when the discharge valve is molded on center part of the molded product of the discharge valve.

Also, still another object of the present invention is to provide a discharge valve apparatus for a reciprocating compressor which can easily eject the discharge valve molding by forming a gate passage which is formed on the metal mold when the discharge valve is molded, on a first metal mold which is fixed.

In order to achieve the above objects, there is provided a discharge valve apparatus for a reciprocating compressor comprising: a discharge cover having a built-in volume so as to cover front end surface of a cylinder; a discharge valve disposed to be contacted/separated to/from the front end surface of the cylinder by a piston which undergoes a reciprocating movement inside the cylinder; and a valve spring having its both ends installed to be adhered to rear surface of the discharge valve and to inner surface of the discharge cover facing to the rear surface of the discharge valve so as to elastically supporting the rear surface of the discharge valve, and the valve spring is formed as a conical type in which a rotation radius is gradually reduced or increased so as to prevent a part from impacting with next part during compression.

MODE FOR CARRYING OUT THE PREFERRED EMBODIMENTS

Figure 1:
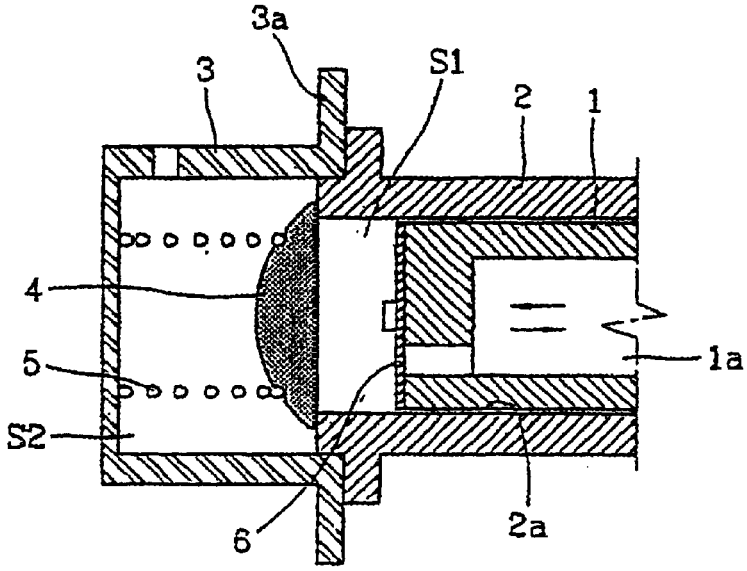
FIG. 1 BACKGROUND ART
FIG. 1 is a longitudinal cross-sectional view showing an embodiment of a discharge valve apparatus in a conventional reciprocating compressor.
Figure 2:
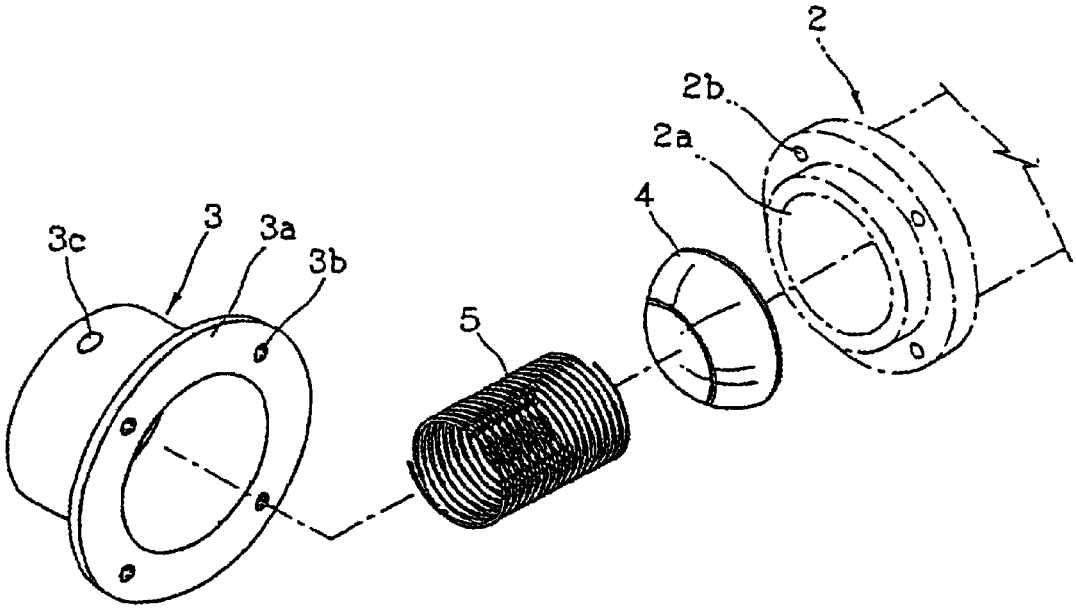
FIG. 2 BACKGROUND ART
FIG. 2 is an exploded perspective view showing an embodiment of the discharge valve apparatus of the conventional reciprocating compressor.
Figure 3A:
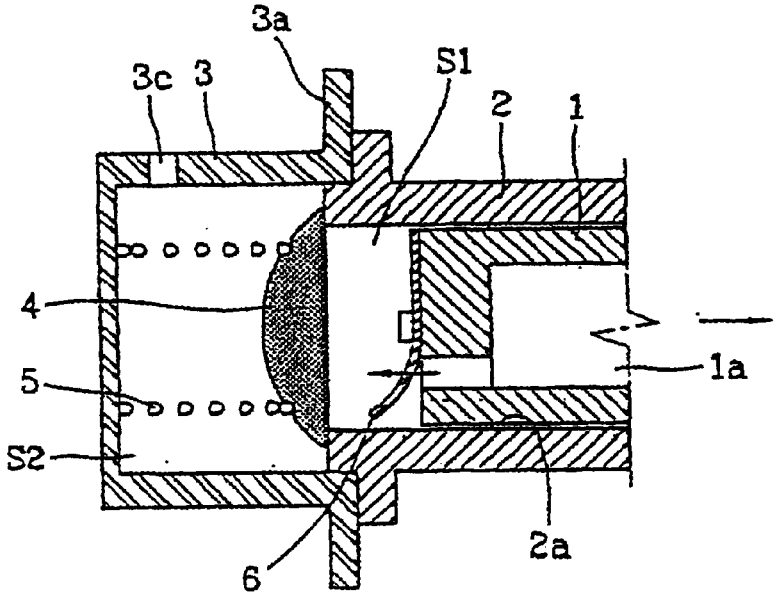
FIG. 3A BACKGROUND ART
FIG. 3A is a longitudinal cross-sectional view showing a suction process by the discharge valve apparatus in the conventional reciprocating compressor.
Figure 3B:
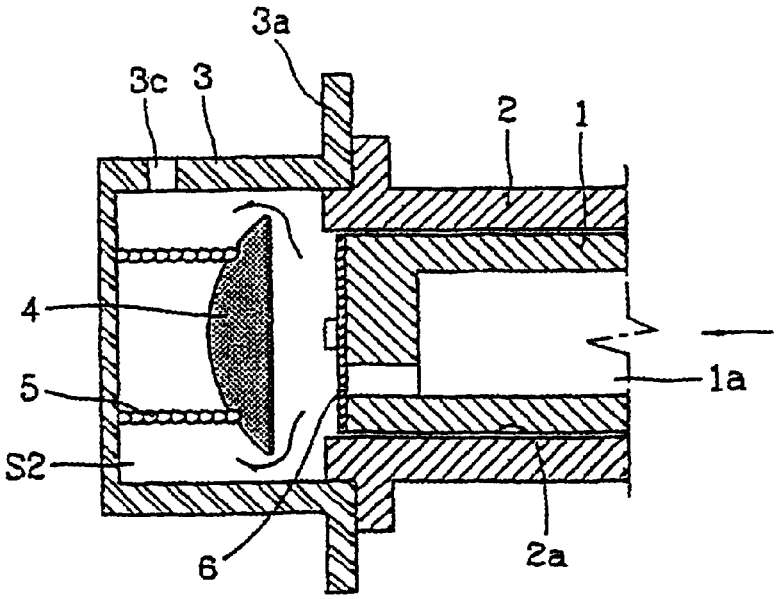
FIG. 3B BACKGROUND ART
FIG. 3B is a longitudinal cross-sectional view showing a discharge process by the discharge valve apparatus in the conventional reciprocating compressor.
Figure 4:
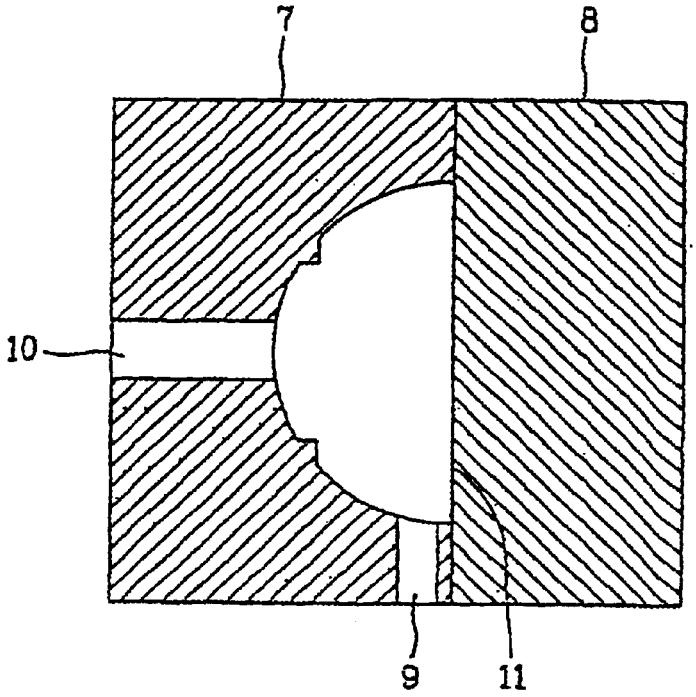
FIG. 4 BACKGROUND ART
FIG. 4 is an exemplary view showing a metal mold for molding a discharge valve in the conventional discharge valve apparatus.
Figure 5:
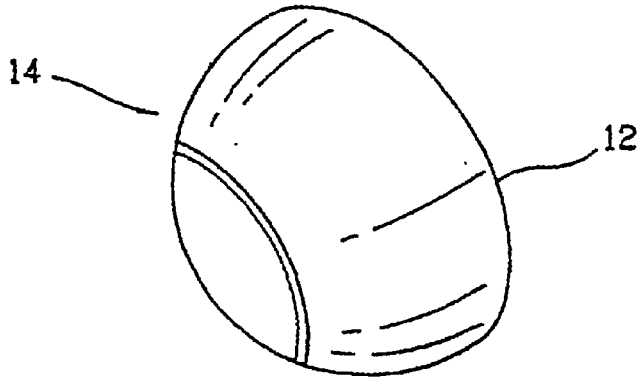
FIG. 5 BACKGROUND ART
FIG. 5 is a perspective view showing a discharge valve molding produced in the metal mold of FIG. 4.

The present invention will now be described with reference to accompanying drawings. In addition, same reference numerals are used for the same components as those of the conventional art.

Figure 6:
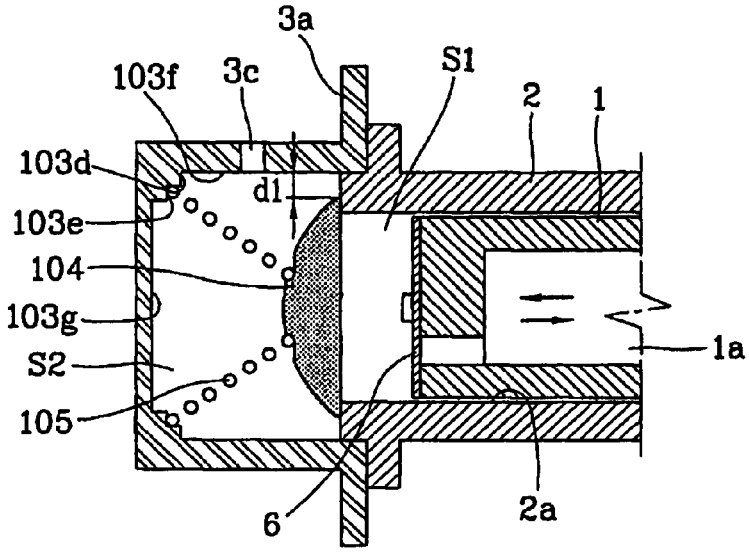
FIG. 6 is a longitudinal cross-sectional view showing an embodiment of a discharge valve apparatus for a reciprocating compressor according to the present invention.
Figure 7:
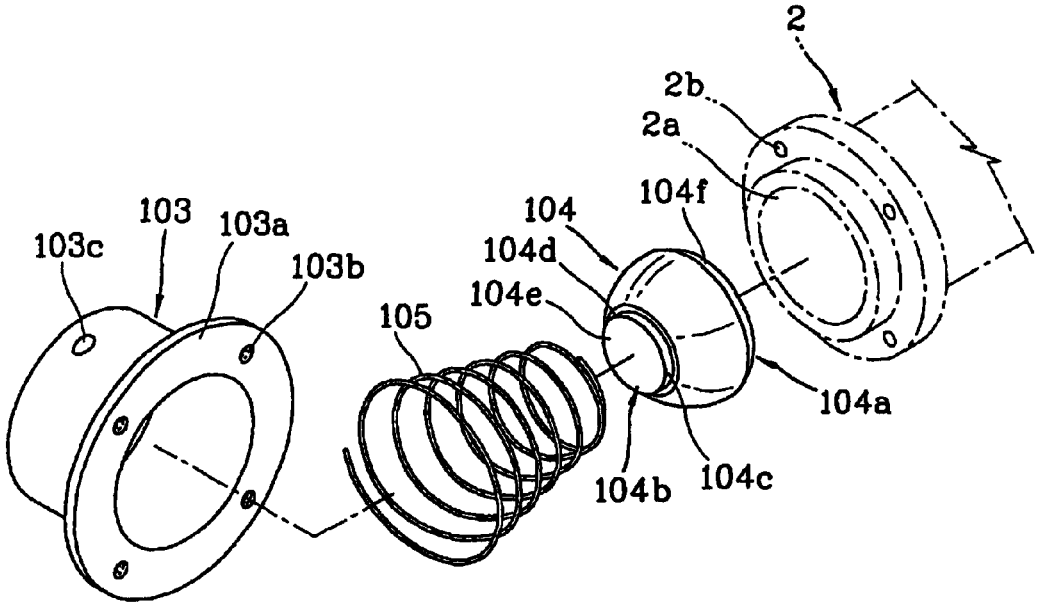
FIG. 7 is an exploded perspective view showing an embodiment of a discharge valve apparatus for a reciprocating compressor according to the present invention.

As shown in FIGS. 6 and 7, a discharge valve apparatus for a reciprocating compressor according to the present invention comprises: a discharge cover 103 fixedly installed on a certain discharge space S2 which is disposed on front end surface of a cylinder 2 so as to cover the front end surface of the cylinder 2 in which a piston 1 is inserted; a discharge valve 104 disposed inner side of the discharge cove 103 for opening/closing the cylinder 2 by being contacted/separated to/from the front end surface of the cylinder 2 when the piston 1 undergoes a reciprocating movement; and a valve spring 105 having both ends supported by inner surface of the discharge cover 103 and by rear surface of the discharge valve 104 facing to the inner surface of the discharge cover 103.

The discharge cover 103 is formed as a hat having a flange unit 103*a* including a coupling hole 103*b* on an opened side so as to be coupled to a flange unit 2*a* on the front end surface of the cylinder 2 using a bolt, and includes a discharge space S2 larger than a diameter of the discharge valve 104 so that the discharge valve 104 can freely undergo the reciprocating movement with a certain gap d1 between the outer circumferential surface of the discharge valve 104.

Also, a first stepped unit 103*d* is formed on a part where the inner side surface 103*f* and the inner wall surface 103*g* of the discharge cover 103 are closed together in the discharge cover 103, and therefore an abrasion which may be generated by impact of the front end of the valve spring 105 to the inner wall surface 103*g* of the discharge cover 103 can be prevented. In addition, a second stepped unit 103*e* next to the first stepped unit 103*d* is formed, and end of the valve spring 105 is inserted therein.

The discharge valve 104 is formed as a hemisphere. And a pressure face unit 104*a* in the discharge valve 104 is contacted/separated to/from the front end surface of the cylinder 2, and one end of the valve spring 105 is adhered to a spring insert unit 104*c* of the pressure back face unit 104*b*.

Also, the spring insert unit 104*c* has a vertical portion 104*d* and a horizontal portion 104*e*, and thereby the spring insert unit 104*c* is forcedly inserted into the front end of the valve spring 105 when the discharge valve 104 is operated. Therefore, a structure of not escaping from the valve spring 105 is made.

In addition, an under cutting surface unit 104*f* of taper shape next to the pressure face unit 104*a* is formed on the pressure back face unit 104*b*. Therefore, the ejecting of the discharge valve molding is easy when the discharge valve is fabricated, and a damage on the metal mold can be prevented.

Also, it is desirable that the outer diameter of the discharge valve 104 smaller than the inner diameter of the discharge cover 103 by more than 1 mm. Then, a flowing resistance during the linear reciprocating movement of the discharge valve 104 and the abrasion by the contact with the discharge cover 103 caused by the eccentric force of the valve spring 105 can be prevented.

Figure 8A:
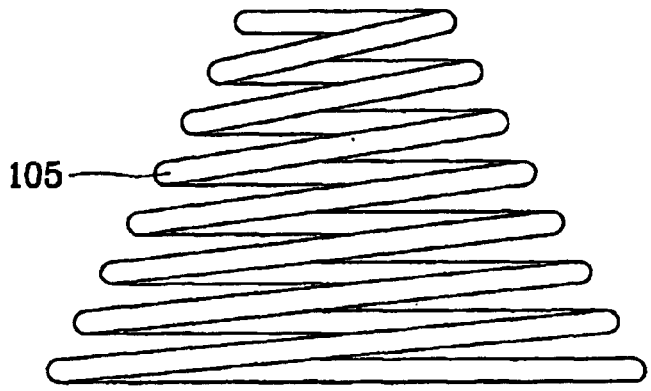
FIG. 8A is a front view showing a valve spring in the discharge valve apparatus for the reciprocating compressor according to the present invention.
Figure 8B:
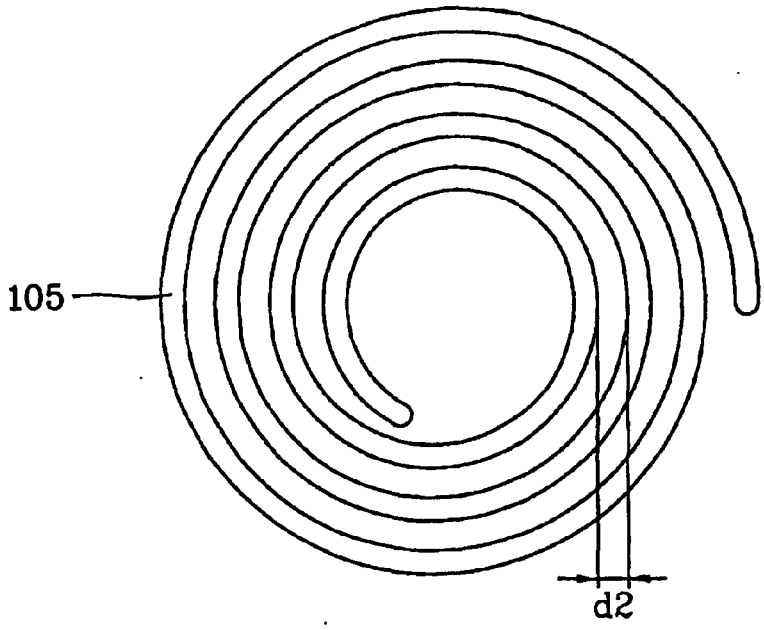
FIG. 8B is a plan view showing a state when the valve spring in the discharge valve apparatus for the reciprocating compressor is projected on inner wall surface of a discharge cover.
Figure 9:
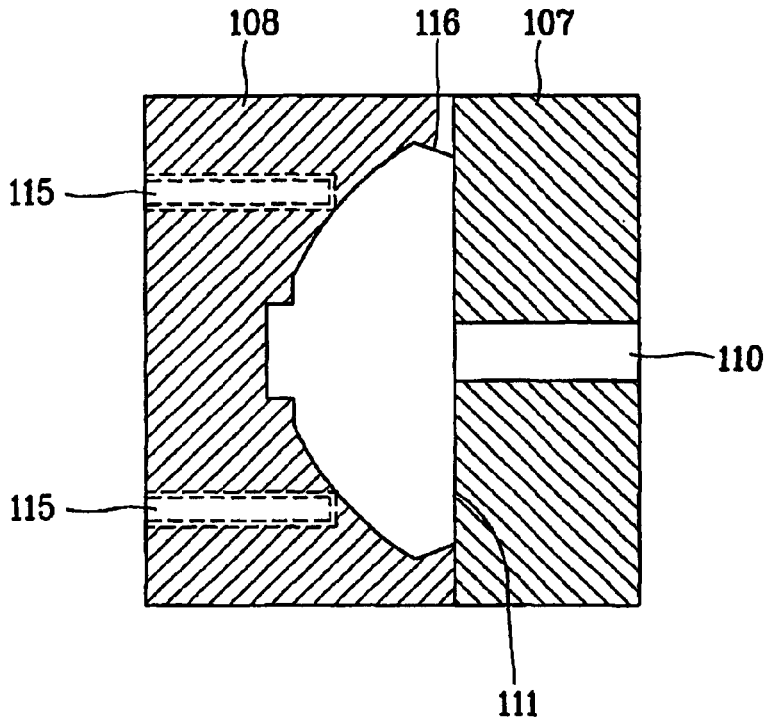
FIG. 9 is an exemplary view showing a metal mold for molding the discharge valve in the discharge valve apparatus for the reciprocating compressor according to the present invention.

As shown in FIGS. 8A and 8B, the valve spring 105 is a compressed coil spring of conical shape having one end closely supported by the second stepped unit 103*d* formed on inner side surface of the discharge cover 103, and the other end inserted into the spring insert unit 104*c* of the discharge valve 104.

Also, the valve spring 105 is formed as a conical type in which the rotation radius is gradually reduced or increased so as to prevent a part from impacting to next parts during compression. In addition, winding number of the wire which is an important element in deciding elastic force is decided according to a noise characteristic and a pressure dispersion inside the discharge cover. In the present invention, the wire is wound more than twice in order to prevent the generation of the eccentric force caused by biased application of the elastic force to opened end direction of the valve spring 105, and in order to make the elastic force be applied equally. However, it is desirable that the wire is wound 2.3 times in real application. And accordingly, the moving instability of the discharge valve 104 can be solved.

Also, the valve spring 105 is formed to have a certain gap d2 between the respective wire of the valve spring 105 when the valve spring 105 is projected on the inner wall surface 103*g* of the discharge cover.

In addition, it is desirable that a wound rotation center of the valve spring 105 and the center of the discharge valve 104 are on same axial line.

Also, a broad end part of the valve spring 105 may be supported by the inner side of the discharge cover 3, and on the contrary, a small end part of the valve spring may be supported by the inner side of the discharge cover 3.

Figure 10:
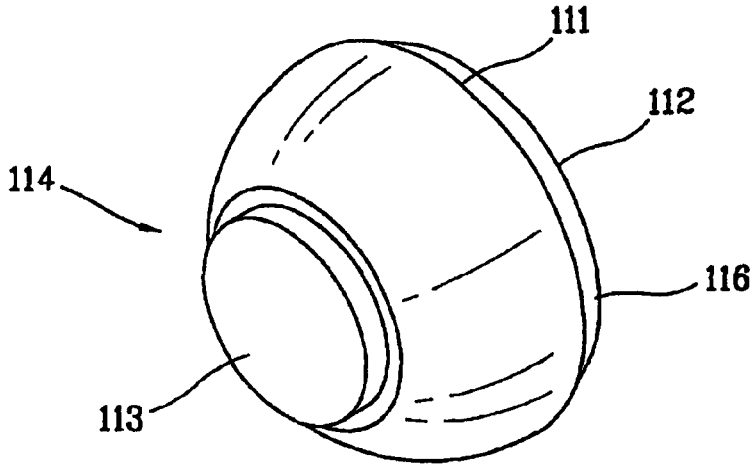
FIG. 10 is a perspective view showing a discharge valve molding produced in the metal mold of FIG. 9.

And, as shown in FIGS. 10 and 11, the discharge valve 104 is injection molded through a fixed first metal mold 107 on which a contour making the pressure face unit 112 of the discharge valve 104 is formed, and a second metal mold 108 on which a contour making the pressure back face unit 114 of the discharge valve 104 and the cutting surface unit 116 is formed.

Therefore, a parting line 111 is formed between the pressure face unit 112 and the pressure back face unit 114 of the discharge valve 104. In addition, a part where the contour of the pressure back face unit 114 meets the parting line 111 becomes an under cutting surface 116 which is slightly slanted, and therefore the discharge valve molding is separated as adhering to the movable second metal mold 108 when the metal molds are separated. In addition, the discharge valve molding is ejected by a plurality of eject pins 115 formed on inside of the second metal mold 108.

In addition, a gate through which the medium is injected is formed on the first metal mold 107 having the contour of the pressure surface unit 112 of the discharge valve 104.

As described above, appropriate choosing the positions of the gate 110 and the parting line 111 makes the ejecting of the discharge valve molding be easy.

The unexplained reference numerals 1*a* designates a refrigerant gas passage, 2*a* is a penetrating hole, 2*b* is a coupling hole, and a S1 designates a compression space.

General operations of the discharge valve apparatus for the reciprocating compressor according to the present invention are similar to those of the conventional art.

When the piston 1 integrated with an armature (not shown) of a reciprocating motor (not shown) undergoes a reciprocating movement inside the cylinder 2, the refrigerant gas is sucked and compressed inside the compression space S1 of the cylinder 2 through the refrigerant gas passage 1*a* formed inside the piston 1, and then discharged through the discharge space S2 of the discharge cover 103. And the processes are repeated.

Figure 11A:
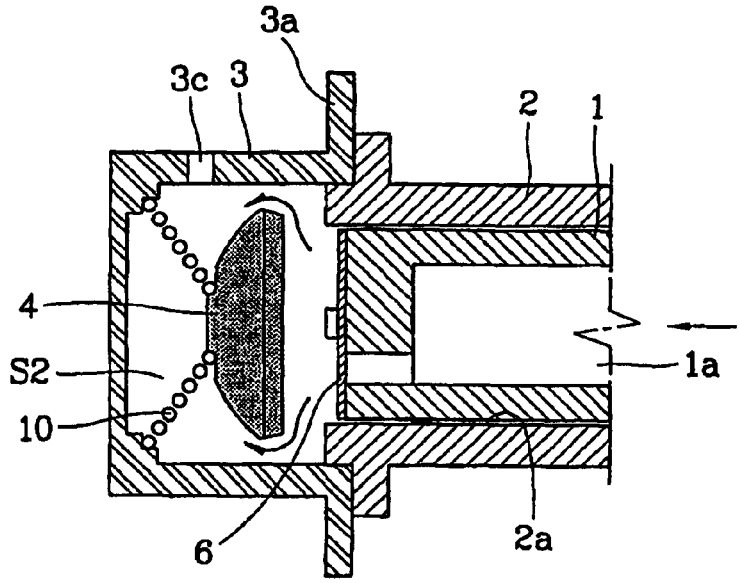
FIG. 11A is a longitudinal cross-sectional view showing a suction process by the discharge valve apparatus for the reciprocating compressor according to the present invention.

As shown in FIG. 11A, a new refrigerant gas is sucked through the refrigerant gas passage 1*a* in the piston 1, compressed in the compression space S1 as pushing the suction valve 6 installed on the front end surface of the piston 1, and discharged to the discharge space S2 at a certain time point during the suction stroke of the piston 1.

Figure 11B:
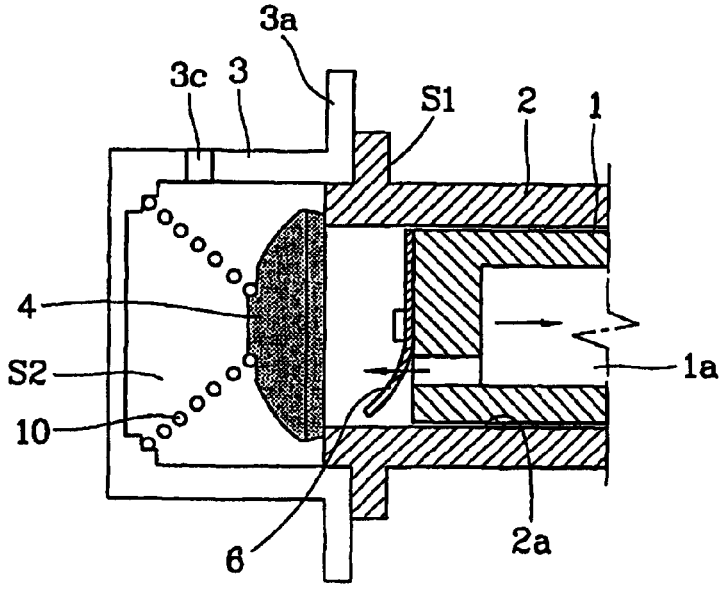
FIG. 11B is a longitudinal cross-sectional view showing a discharge process by the discharge valve apparatus for the reciprocating compressor according to the present invention.

After that, as shown in FIG. 11B, the sucked gas filled in the compression space S1 of the cylinder 2 is compressed by being pushed by the piston 1, and discharged to the discharge space S2 as pushing the discharge valve 104 during the compression and discharge strokes of the piston 1. The compressed gas filled in the discharge space S2 is discharged out of the discharge valve assembly being pushed by newly sucked gas during the next compression and discharge strokes of the piston 1.

On the other hand, the pressure in the compression space S1 is smaller than the elastic force of the valve spring 105 during the suction stroke of the piston 1, and therefore the valve spring is returned and the discharge valve 104 is adhered to the front end surface of the cylinder 2.

On the contrary, the pressure in the compression space S1 is larger than the elastic force of the valve spring 105 during the compression and discharge strokes of the piston 1, and therefore the discharge valve 104 is pushed and the valve spring 105 is compressed. At that time, the rotation radius of the valve spring 105 is gradually reduced from the discharge cover 103 toward the discharge valve 104 so that a part is not contacted to the other parts, and therefore the noise caused by impacts of respective parts during compression can be prevented.

Industrial Applicability

As so far described, according to the discharge valve apparatus for the reciprocating compressor of the present invention, the rotation radius of the valve spring is set to be gradually reduced or increased, and then impacts of a part to the other parts is prevented, whereby the impact noise caused by the impacts of the respective during the compression of the valve spring in accordance with the compression and discharge strokes of the piston can be prevented.

Also, one or more stepped units are formed on the discharge cover side where the valve spring is coupled, and therefore the valve spring is closely supported. And then, the eccentric force which may be generated by the continued reciprocating movements of the valve spring can be prevented.

Also, the parting line is formed on center part of the discharge valve and the gate is formed on fixed metal mold which used for fabricating the discharge valve, and therefore the ejecting of the discharge valve becomes easy and the post-fabrication becomes easy because of the characteristic of the discharge valve shape. In addition, a life span of the metal mold is increased, and generation of the burr can, be prevented.

In addition, the fabrication metal mold is easy to be ejected when the discharge valve is fabricated by forming an undercutting surface which is tapered. And, the vertical portion and the horizontal portion of same diameter as the inner diameter of the spring are formed on the spring insert unit, whereby the abrasion of the discharge valve caused by the repeated movements can be prevented.

What is claimed is:

1. A discharge valve apparatus for a reciprocating compressor comprising:

a cylinder having a front end surface and a rear end surface;

a discharge cover having a built-in volume so as to cover the front end surface of the cylinder;

a piston within said cylinder, said piston being capable of a reciprocating movement between a first position and a second position;

a hemispherically shaped discharge valve disposed so as to be in contact with the front end surface of the cylinder when said piston is in said first position and separated from said front end surface of said cylinder when said piston is in said second position; and a valve spring having both ends respectively engaged with a rear hemispherically shaped surface of the discharge valve and with an inner surface of the discharge cover, said inner surface of said discharge cover facing the rear surface of the discharge valve, said valve spring elastically supporting the rear surface of the discharge valve, wherein the valve spring is formed with a conical shape in which a rotation radius is gradually tapered so as to prevent adjacent portions of said valve spring from impacting with each other when said valve spring is in a compressed state.

2. The apparatus according to claim 1, wherein the valve spring is wound more than twice.

3. The apparatus according to claim 1, further comprising at least one stepped surface being formed inside the discharge cover, and wherein a front end of the valve spring is prevented from contacting an inner wall of the discharge cover.

4. The apparatus according to claim 3, further comprising a second stepped surface in which an end of the valve spring is inserted, said second stepped surface being formed adjacent to the at least one stepped surface and preventing said front end of the valve spring from engaging said inner wall.

5. The apparatus according to claim 1, said valve spring including a plurality of coils, wherein a gap is formed between said coils of the valve spring.

6. The apparatus according to claim 1, wherein a center of the valve spring and a center of the discharge valve are on a common axial line.

7. The apparatus according to claim 1, wherein a gap between an outer diameter of the discharge valve and an inner diameter of the discharge cover is more than 1 mm.

8. The apparatus according to claim 1, wherein the discharge valve comprises:

a plane pressure face engaging the front end surface of the cylinder; and a pressure rear face extending from a side facing the plane pressure face, wherein a diameter of said pressure rear face gradually reduces in a direction from an edge toward a center of said pressure rear face.

9. The apparatus according to claim 8, further comprising a parting line being formed on a position where the plane pressure face meets the pressure rear face.

10. The apparatus according to claim 8, wherein the discharge valve further comprises an undercutting surface being formed in a position opposite to at least one of the pressure face and the pressure rear face.

11. The apparatus according to claim 8, wherein the pressure rear face further comprises a spring insert capable of being inserted into the valve spring.

12. The apparatus according to claim 11, wherein the spring insert includes a vertical portion and a horizontal portion.

13. A method of making the apparatus of claim 1, said method comprising:

injection molding the discharge valve with a first metal mold and a second metal mold, wherein said first metal mold includes a contour for forming the plane pressure face and the second metal mold includes a contour for forming the pressure rear face and the undercutting surface on the discharge valve; and forming a gate on said first metal mold on which the plane pressure face unit is molded when the discharge valve is injection molded.

14. The method according to claim 13, wherein a plurality of eject pins are formed on the second metal mold on which the pressure rear face is formed when the discharge valve is injection molded.

15. A discharge valve assembly for a reciprocating compressor comprising:

a discharge cover having an interior space, an inner surface and an opened end;

a hemispherically shaped discharge valve disposed so as to be in a position adjacent to said opened end of said discharge cover, said discharge valve including a rear hemispherically shaped surface and a front surface; and a conically-shaped valve spring having a pair of ends respectively engaged with the rear surface of the discharge valve and with the inner surface of the discharge cover, said inner surface of said discharge cover facing the rear surface of the discharge valve and said valve spring elastically supporting the rear surface of the discharge valve, wherein the valve spring includes a rotation radius tapered so as to prevent adjacent portions of said valve spring from impacting with each other when said valve spring is in a compressed state.

16. The discharge valve assembly according to claim 15, wherein the discharge valve comprises:

a plane pressure face; and a pressure rear face extending from a side facing said valve spring, wherein a diameter of said pressure rear face gradually reduces in a direction from an edge of said pressure rear face toward a center of said pressure rear face.

17. The discharge valve assembly according to claim 16, wherein the discharge valve further comprises an undercutting surface being formed in a position opposite to at least one of the pressure face and the pressure rear face.

18. The discharge valve assembly according to claim 17, wherein the pressure rear face further comprises a spring insert capable of being inserted into the valve spring.

19. The apparatus according to claim 1, wherein the valve spring is wound 2.3 times.

20. The method according to claim 13, further comprising forming a parting a line between the plane pressure face and pressure rear face of the discharge valve.

* * * * *